US005997093A

United States Patent [19]

Gollin et al.

[11] Patent Number: 5,997,093

[45] Date of Patent: Dec. 7, 1999

[54] ADJUSTABLE CHAIR ARM

[75] Inventors: Timothy J. Gollin, Houston; Dale W. Mason, Sugarland, both of Tex.

[73] Assignee: Gollin & Co., Inc.

[21] Appl. No.: 09/113,968

[22] Filed: Jul. 9, 1998

Related U.S. Application Data

[60] Provisional application No. 60/065,396, Nov. 13, 1997.

[51] Int. Cl.[6] ..... A47C 7/54

[52] U.S. Cl. ..... 297/411.36; 297/353

[58] Field of Search ..... 297/411.36, 411.3, 297/411.37, 353; 248/118, 118.3

[56] References Cited

U.S. PATENT DOCUMENTS

| | | | |
|---|---|---|---|
| 5,324,096 | 6/1994 | Schultz | 297/411.36 |
| 5,435,626 | 7/1995 | Lai | 297/411.36 |
| 5,586,811 | 12/1996 | Tornero | 297/411.36 |
| 5,620,233 | 4/1997 | Corwin | 297/411.36 |
| 5,735,577 | 4/1998 | Lin | 297/411.36 |

*Primary Examiner*—Anthony D. Barfield
*Attorney, Agent, or Firm*—Kuffner & Associates

[57] ABSTRACT

A vertically adjustable, multi-position chair arm assembly includes a flat metal support bracket having a generally straight uppermost section. The chair arm assembly further includes a plastic shell housing mounted on the generally straight section of the support tube. The single piece shell housing retains a pair of mating sleeves which seat and lock in the draft angle of the shell housing. The uppermost section of the metal support bracket is enclosed by a molded plastic cover. The mating sleeves provide a channel for receiving and retaining the plastic covered section of the metal support bracket. The sleeve channel provides a plastic to plastic interface whereby the total material tolerances are significantly reduced and thereby minimizing wobble. A locking mechanism housed within the shell housing is in positive locking engagement with a punched locking rack formed in the metal support bracket.

13 Claims, 7 Drawing Sheets

ADJUSTABLE CHAIR ARM

RELATED APPLICATIONS

This application claims the benefit of U.S. Provisional Application Serial No. 60/065,396 filed on Nov. 13, 1997.

BACKGROUND OF THE INVENTION

1. Technical Field

The present invention relates to chairs, and more particularly to a multi-position adjustable arm for office chairs, which mounts directly to the bottom of the chair.

2. Background Art

A need exists for a multi-position chair arm adapted for vertical height adjustment, which permits a wide latitude in vertical positioning of the chair arm, is relatively easily manufactured, which is reliable in operation, and provides a wide variety of adjustable positions for the user. The chair design industry has heretofore provided a wide variety of chairs for the office environment which are ergonomically designed for the comfort of the user. Some of these chairs provide height adjustable chair arms, typically plastic assemblies fitted over plastic and metal supports that provide the structural strength for the chair arm assembly. These height adjustable chair arms typically utilize screw fastening systems and punched or slotted metal tube or brackets to provide engagement for the height adjustment mechanism. Many height adjustable arms which include a plastic height adjustment assembly on a metal substructure encounter problems with wobble and may rattle or feel loose, particularly at the top of the height adjustment range. The metal substructure is typically stamped steel with rough or sharp edges. The plastic housing quickly wears at the plastic to metal interface resulting in a loose and wobbling chair arm.

A further problem common with these type of chair arm assemblies is that the cumulative tolerances on the metal support width and thickness, paint coat thickness and tolerances of the molded plastic components all combine to create objectionable rattle and play in the final assembly. The difficulty of maintaining a tight fit between a plastic housing and a metal substructure results in excessive wear and unwanted movement or play from side to side and front to back, further resulting in rattle and noise.

Adjustable chair arms in the prior art lack height adjustment mechanisms which utilize a positive engagement locking mechanism. In the prior art, height adjustment mechanisms comprise several components, usually mounted pivotally on an inner wall of a sliding sleeve. In some of the prior art, these height adjustment mechanisms are in communication with a guiding slot and further comprise a portion with a lock pin biased with an integral leaf spring against an inner wall of the sliding sleeve to engage notches in the guiding slot in the support bracket portion of the arm. Shifting the lock pin along the guiding slot enables engagement of the lock pin with another one of the notches. Other height adjustment mechanisms in the prior art are in communication with a plurality of ratchet recesses spaced longitudinally along a support bracket and use a "ratchet dog", a biasing member for urging the ratchet dog into successive engagement with the plurality of ratchet recesses, and a means such as a movable slider for selectively displacing the spring to effect disengagement of the ratchet dog from the successive ratchet recesses. However, these arms have multiple pivotal components making them more difficult and expensive to manufacture.

Further, these arms wear from use, the arms fail to remain positioned at the desired detent, thus no longer working as a height adjustable arm.

Finally, traditional one piece plastic shells provide structural integrity as opposed to shells comprising a plurality of components; however, injection processes which form one-piece plastic shells by necessity of the molding process have draft angles, variances in the injected part making one end of the injected part smaller with respect to the other end, thus allowing the injected part to be removed from the injection mold. The draft angle of the one piece plastic shell induces a differential in tolerance of fit of the one piece plastic shell on the bracket onto which the one piece plastic shell is mounted; this differential, in turn, causes wobble in the arm assembly as the arm is raised on the bracket.

DISCLOSURE OF INVENTION

It is, therefore, an object of the invention to provide a substantially wobble-free multi-position chair arm.

It is a further object of the invention to provide an adjustable chair arm which minimizes wobble by reducing the tolerances between the chair arm housing and the metal support bracket.

It is a further object of the invention to provide an adjustable chair arm in which the height adjustment mechanism has no pivotal components, making them easier and less expensive to manufacture.

It is a further object of the invention to provide an adjustable chair arm in which the height adjustment mechanism utilizes a positive engagement locking mechanism to counteract wear and permit height adjustment over a longer life time.

It is yet a further and final object of the invention to provide an adjustable chair arm utilizing a single piece plastic shell for structural integrity but removing the draft angle problem by providing two mating sleeves which seat and lock in the draft angle of an injection molded one piece plastic shell, providing a vertical fit in which the metal bracket with its mating plastic parts can ride.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

Referring now to the drawings wherein like elements are numbered alike in the several FIGURES:

FIG. 1 is a perspective view of the vertically adjustable, multi-position chair arm in accordance with the present invention;

FIG. 2 is a section view of the vertically adjustable, multi-position chair arm of the invention;

FIG. 3 is an exploded view of the bracket covering for the metal support bracket of the vertically adjustable, multi-position chair arm of the invention;

FIG. 4 is a section view of the vertically adjustable, multi-position chair arm of the invention;

FIG. 5 is an exploded view of the plastic retaining sleeve of the vertically adjustable, multi-position chair arm of the invention;

FIG. 6 is a perspective view of the shell housing of the vertically adjustable, multi-position chair arm of the invention;

FIG. 7 is a perspective view of the base of the lock mechanism of the vertically adjustable, multi-position chair arm of the invention; and FIG. 8 is a perspective view of the lock mechanism button actuator of the vertically adjustable, multi-position chair arm of the invention.

BEST MODE FOR CARRYING OUT THE INVENTION

Figure 1:
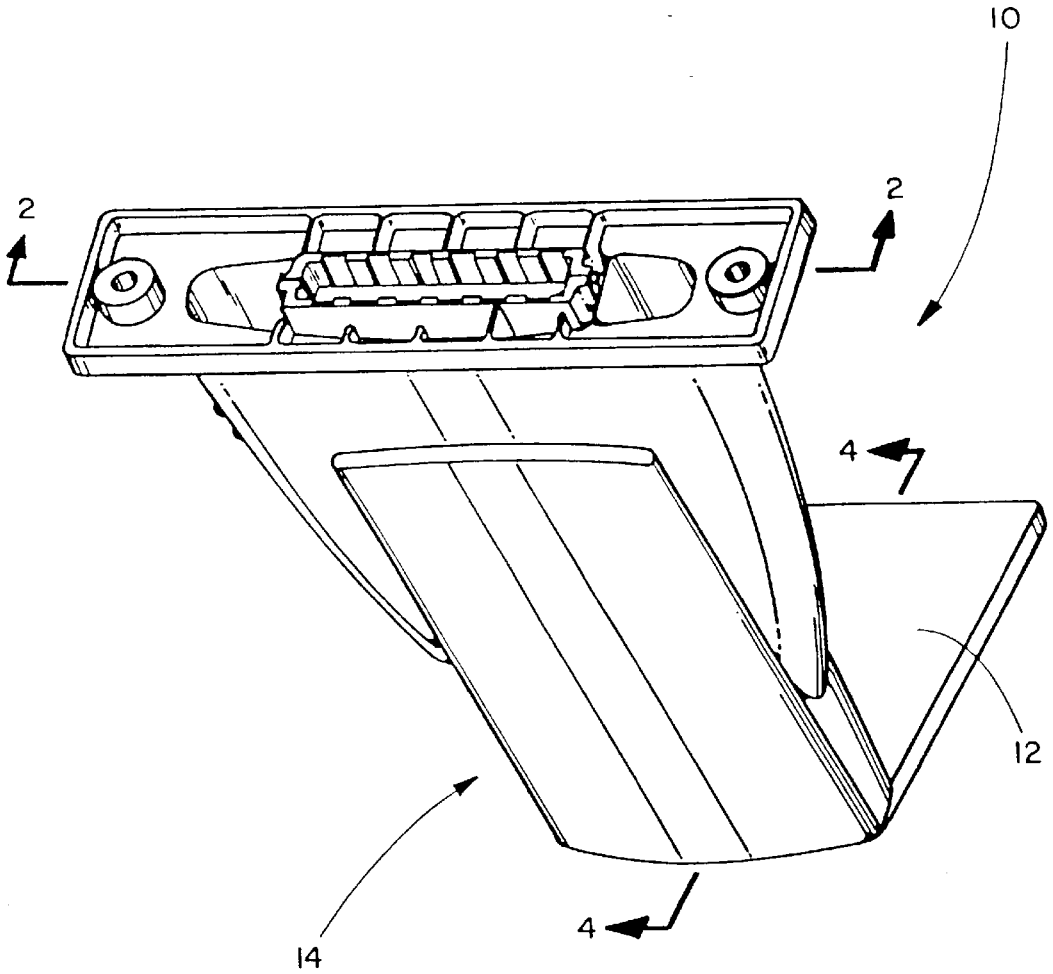

The present invention provides a vertically adjustable, multi-position chair arm attachable to a chair seat, as illustrated in FIG. 1. In the following figures, FIG. 1 through FIG. 8, the instant invention's vertically adjustable, multi-position chair arm is generally identified by the reference numeral 10.

As shown in FIG. 1, the instant invention's vertically adjustable, multi-position chair arm comprises a support bracket 12 having a generally straight uppermost section, and a vertically adjustable armrest 14 mounted on support bracket 12 having a substantially straight upper portion with the lower end thereof adapted for mounting to the bottom of a chair seat. In the preferred embodiment, support bracket 12 is a steel bracket fabricated from flat bar stock.

Figure 2:
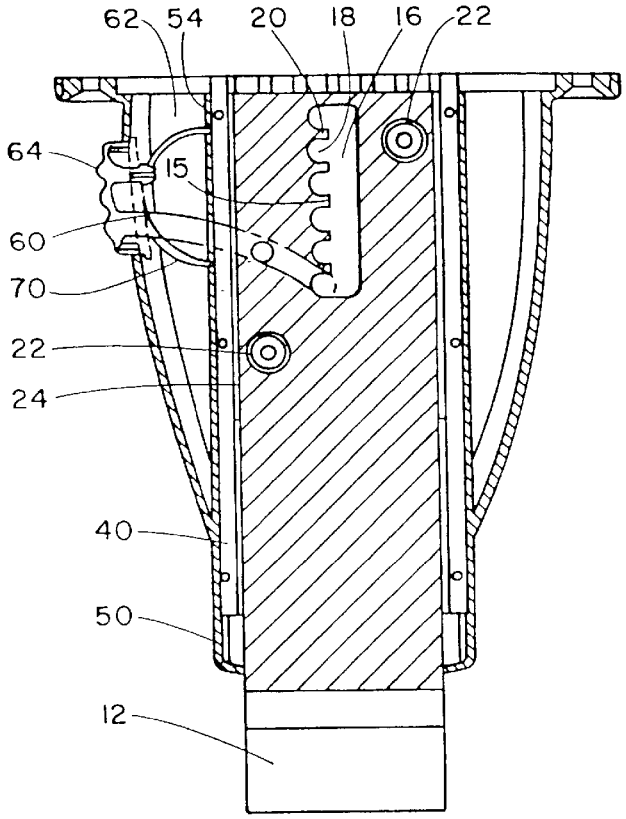

Referring now to FIG. 2, it will be observed that a locking rack 15 is punched in the upper portion of support bracket 12. Locking rack 15 comprises a channel 16 formed along the longitudinal center line in the upper portion of support bracket 12; slots 18 formed along one side of channel 16; and teeth 20 projecting into channel 16 which separate slots 18. The upper portion of support bracket 12 further includes holes 22 which are punched in support bracket 12 simultaneously with locking rack 15 so that holes 22 and locking rack 15 are precisely located relative to each other in support bracket 12.

Figure 3:
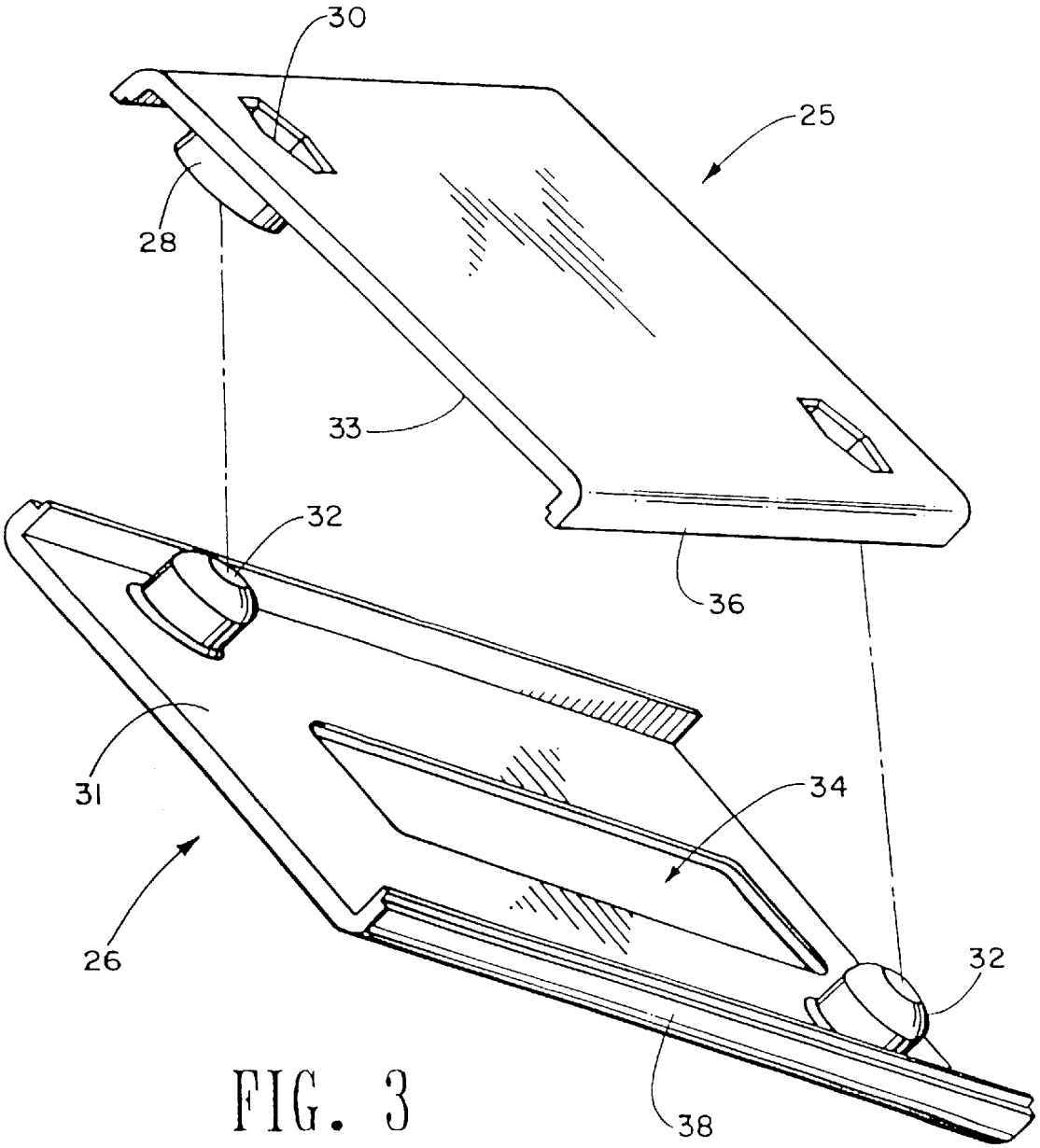

Tolerance stack-up is eliminated in the instant invention's vertically adjustable, multi-position chair arm 10 by enclosing or encapsulating the upper portion of support bracket 12 in an injection molded bracket cover 24. Bracket cover 24, as best shown in FIG. 3, comprises two mating cover sleeves 25 and 26. In the preferred embodiment, mating cover sleeves 25 and 26 are injection molded from a suitable engineering thermoplastic resin such as high density polypropelene to a precise width and thickness. Mating cover sleeve 25 is provided with upstanding, cylindrical hollow pins 28 located on the inner surface 33 of cover sleeve 25 for mating engagement with the holes 22 formed in support bracket 12. Hollow pins 28 further define holes 30 extending therethrough. Mating cover sleeve 26 includes a pair of upstanding locking pins 32 profiled to be received in hollow pins 28. Bracket cover 24 is fixedly attached to the upper portion of support bracket 12 by locating each of the hollow pins 28 of mating cover sleeve 25 in the corresponding holes 22 of support bracket 12. Mating cover sleeve 26 is then mounted to the opposite side of support bracket 12 and secured thereto by forcing locking pins 32 into engagement with hollow pins 28, thus firmly securing the upper portion of support bracket 12 between mating cover sleeves 25 and 26. An opening 34 is formed in mating cover sleeve 26 for exposing channel 16 upon assembly of bracket cover 24 onto support bracket 12. The longitudinal side walls 36 and 38 of mating cover sleeves 25 and 26 form mating profiles so that upon assembly bracket cover 24 presents a flat slide surface along the longitudinal edges thereof. Because bracket cover 24 is positioned onto support bracket 12 by holes 22 which are punched in support bracket 12 when locking rack 15 is also punched in support bracket 12, the total tolerance from locking rack 15 to the edges of the bracket cover 24 is minimized. It will be understood by those skilled in the art that the injection molding process requires injection pieces to have "draft angles", a differential in thickness or other dimension(s) which allow a piece, once formed in an injection mold, to be removed from that injection mold. Accordingly, each of mating cover sleeves 25 and 26 have external draft angles while maintaining essentially straight inner walls 31 and 33; the straight inner walls 31 and 33 eliminate draft angle wobble when mating cover sleeves 25 and 26 are assembled onto support bracket 12.

Figure 4:
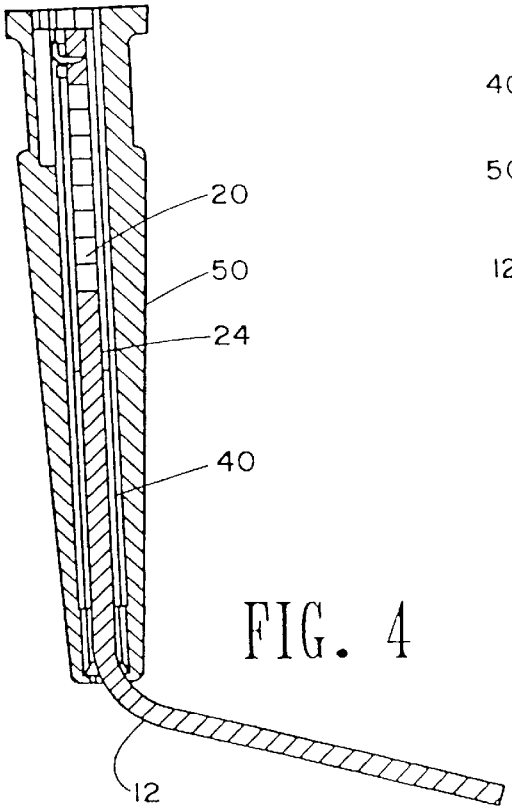

Referring to FIG. 4, it will be observed that the plastic encased upper portion of support bracket 12, encased in bracket cover 24, is received within a slide sleeve 40.

Figure 5:
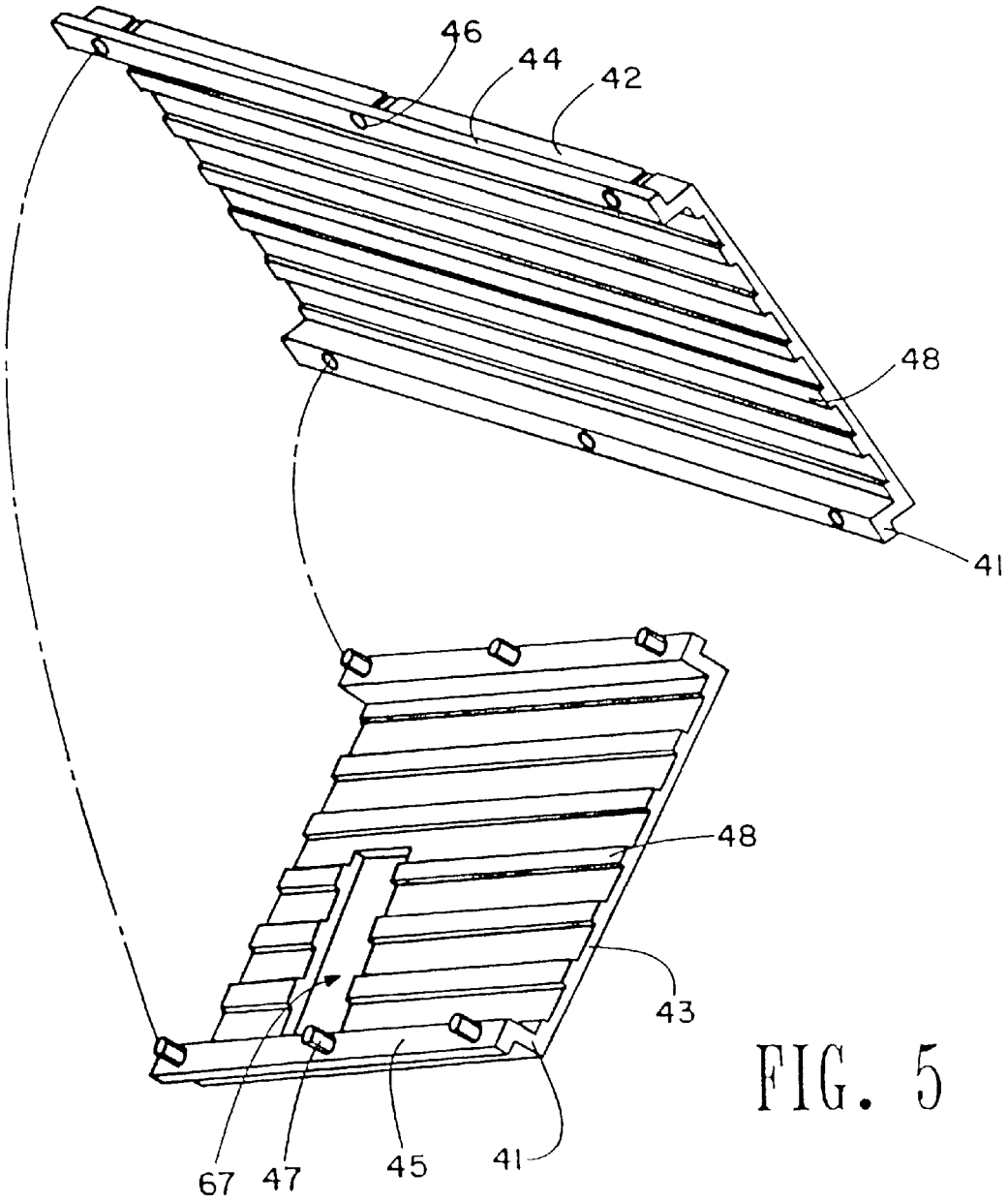

As best shown in FIG. 5, slide sleeve 40 comprises two mating sleeve panels 42 and 43; in the preferred embodiment, mating sleeve panels 42 and 43 are injection molded of a suitable engineering thermoplastic resin such as high density polypropelene to precise dimension. Mating sleeve panels 42 and 43 include side walls 41 terminating in longitudinal edges 44 and 45 which upon assembly of mating sleeve panels 42 and 43 are in facing engagement. Alignment of mating sleeve panels 42 and 43 is maintained by a combination of holes 46 and pins 47 formed in longitudinal edges 44 and 45 of mating sleeve panels 42 and 43. Mating sleeve panel 42 includes two or more tapped holes 46 formed in the edges 44. Mating sleeve panel 43 includes a corresponding number of pins 47 projecting from its edges 45. Holes 46 and pins 47 are spaced along the edges 44 and 45 and are oppositely aligned. Upon assembly of mating sleeve panels 42 and 43, pins 47 are received in holes 46 thereby retaining the two mating sleeve panels 42 and 43 in facing contact along the edges 44 and 45. Mating sleeve panels 42 and 43 further include longitudinally extending ribs 48 formed on the inner surface the bodies of each of mating sleeve panels 42 and 43. Ribs 48 add to the structural integrity of mating sleeve panels 42 and 43, yet permit mating sleeve panels 42 and 43 to flex slightly forming a limited curvature along the longitudinal axis thereof.

Figure 6:
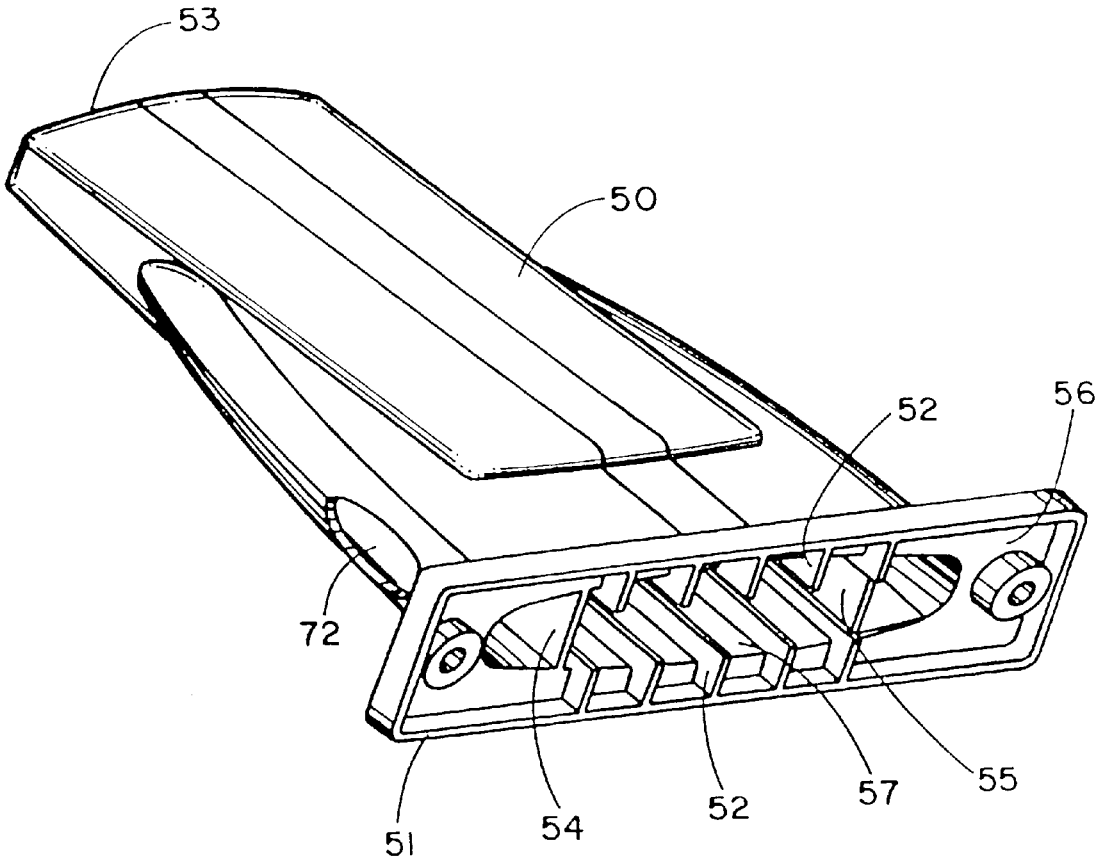

Referring now to FIG. 6, the outer shell of vertically adjustable armrest 14 comprises a single piece housing 50 open at both ends; in the preferred embodiment, housing 50 is also injection molded from a suitable engineering thermoplastic resin such as high density polypropelene. The outer shape or configuration of housing 50 may take various forms and, because of the injection molding process, includes interior draft angles. Housing 50 includes interiorly projecting ribs 52 which extend from the upper end 51 of housing 50 to the lower end 53 of housing 50. Ribs 52 and longitudinal guide walls 54 and 55 form an axial channel 57 in housing 50 for receiving slide sleeve 40 therein. Slide sleeve 40 seats and locks in the draft angle of housing 50. Further, slide sleeve 40 slides on top of support bracket 12 which is encased in bracket cover 24. The limited curvature of mating slide sleeve panels 42 and 43 provides a flexible, floating interference fit between slide sleeve 40 and bracket cover 24 of the support bracket 12, thereby providing a substantially wobble free, vertically adjustable, multi-position chair arm. The upper end 51 of the housing 50 terminates in an arm pad base 56 for mounting an arm pad thereon. Slot 72 is formed in single piece housing 50 for receiving a button actuator.

Figure 7:
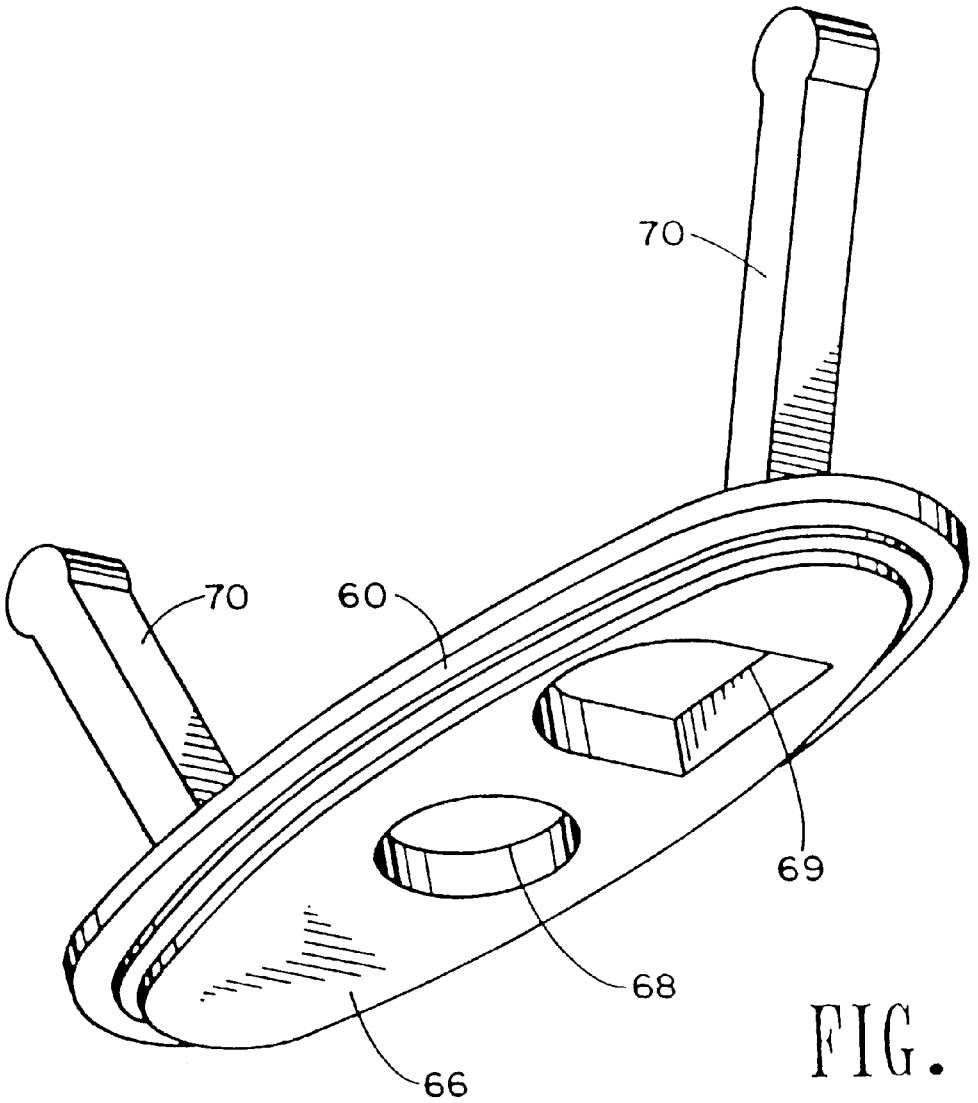

Referring back to FIG. 2, slide sleeve 40 and housing 50 are selectively engaged with locking rack 15 by a lock mechanism located in housing 50. The lock mechanism comprises a lock base 60, received within a cavity 62 in housing 50, and a button actuator 64. As shown in FIG. 7, lock base 60 is a substantially planar member having a raised portion 66 projecting from lock base 60. Raised portion 66 has two holes 68 and 69 formed therein. A pair of flexible legs 70 project from the bottom of lock base 60. Referring back to FIG. 2, lock base 60 is positioned within the cavity 62 so that the flexible legs 70 act as biasing springs and engage guide wall 54, thus pressing lock base 60 against the inner wall of housing 50 so that raised portion 66 projects through button opening 72 formed in the wall of housing 50.

Figure 8:
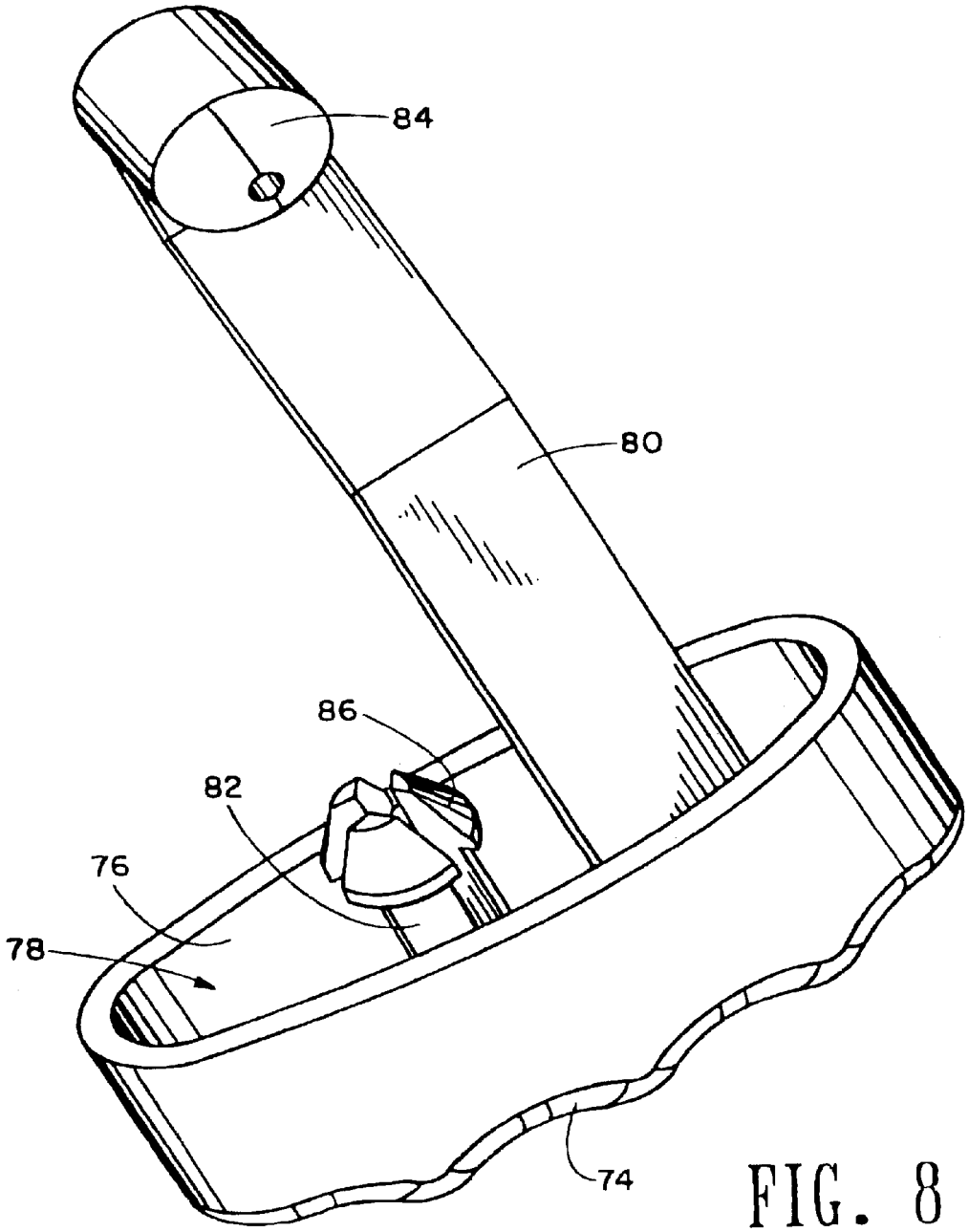

Referring now to FIG. 8, button actuator 64 comprises a button surface 74 having an upstanding flange 76 extending therefrom defining a cavity 78 sized to receive the raised portion 66 of the button base 60. A latch arm 80 and a connector post 82 extend from the bottom of the button surface 74. The latch arm 80 extends through the hole 69 in the raised portion 66 and a slot 67 formed in sleeve 40 for locking engagement with locking rack 15 of support bracket 12. The distal end of arm 80 is provided with a lug 84 projecting perpendicularly therefrom. The lug 84 is sized to be received in slots 18 of the locking rack. The end of the connector post 82 is split into a plurality of flexible fingers forming an enlarged head 86. The fingers flex inwardly so that head 86 will pass through hole 68 of the raised portion 66 and expand outwardly securing button actuator 64 to base 60.

Upon assembly, the vertically adjustable, multi-position chair arm 10 of the invention is slideably secured to support bracket 12. Locking rack 15 is substantially congruently aligned with slot 67 formed in sleeve 40. The vertically adjustable, multi-position chair arm 10 may be raised or lowered by pressing button actuator 64, thereby forcing lug 84 into channel 16 out of locking engagement with the slots 18, allowing housing 50 and slide sleeve 40 to be raised or lowered to the desired position. Upon release of button actuator 64, flexible legs 70 push button actuator 64 and latch arm 70 outwardly, thereby pulling lug 84 into locking engagement with the slots 18 of the lock rack 15, precluding further movement of sleeve 40.

While a preferred embodiment of the invention has been shown and described, other and further embodiments of the invention may be devised without departing from the basic scope thereof, and the scope thereof is determined by the claims which follow.

We claim:

1. A multi-position chair arm, comprising:

an arm support bracket having upper and lower ends, the upper end of said support bracket fixedly attached to a plastic cover, an armrest further comprising a shell housing further comprising an open lower end, an open upper end, an axial channel extending from said open upper end to said open lower end of said shell housing and having an inner wall and an outer wall, and a horizontal base extending outwardly from said open upper end of said shell housing; and a slide sleeve seated within said axial channel of said shell housing; and a lock mechanism for selectively positive locking engagement of said armrest onto said support bracket wherein said plastic cover and said upper end of said support bracket are received in said slide sleeve and are in sliding engagement therewith.

2. The multi-position chair arm of claim 1 further comprising a first aperture in said support bracket, and a second aperture in said slide sleeve wherein said lock mechanism is fixedly attached to said shell housing whereby said first aperture in said support bracket is substantially congruently aligned with said second aperture in said slide sleeve, said locking mechanism is in communication with said first aperture in said support bracket, and said lock mechanism is in communication with said second aperture in said slide sleeve wherein said lock mechanism provides a positive locking engagement of said armrest onto said support bracket.

3. The multi-position chair arm of claim 2 wherein said lock mechanism further comprises a button actuator providing positive locking engagement.

4. The multi-position chair arm of claim 2 wherein said first aperture has a substantially rectangular shape with teeth projecting into said first aperture from at least one side of said first aperture, thus forming slots.

5. The multi-position chair arm of claim 4 wherein said locking mechanism further comprises a button actuator providing positive locking engagement.

6. The multi-position chair arm of claim 5 wherein said button actuator further comprises one or more legs whereby said legs protrude into said axial channel of said shell housing, said legs providing a biasing action forcing said button actuator against said inner wall of said axial channel; and a latch arm with a distal end having a lug sized to be received in said slots, projecting perpendicularly from said distal end of said latch arm whereby said latch arm extends through said first aperture in said support bracket and said second aperture in said slide sleeve, said button actuator disengages said lug arm from a selected one of said slots when said button actuator is actuated against the biasing action of said legs, and said button actuator engages said lug arm into a selected one of said slots when said button actuator is not actuated against the biasing action of said legs.

7. The multi-position chair arm of claim 1 wherein said support bracket is a steel bracket fabricated from flat bar stock.

8. The multi-position chair arm of claim 1 wherein said lock mechanism selectively locks said shell housing against relative axial movement to said support bracket.

9. A multi-position chair arm, comprising:

an armrest support member having upper and lower end portions;

a support member cover enclosing the upper end portion of said support member;

an armrest further comprising a shell housing having an open upper end and an open lower end;

an axial channel extending from said open upper end to said open lower end of said shell housing;

a slide sleeve seated within said axial channel of said shell housing;

said cover and said upper end portion of said support member being received in said slide sleeve in sliding engagement therewith;

a lock mechanism selectively locking said shell housing to said support member.

10. The chair arm of claim 9 wherein said shell housing and said slide sleeve are locked against relative axial movement.

11. The chair arm of claim 9 wherein said lock mechanism comprises a button actuator providing positive locking engagement with said support member.

12. The chair arm of claim 9 wherein said support member cover comprises two substantially identical oppositely facing plastic panels securing said support member between said plastic panels.

13. The chair arm of claim 12 wherein said slide sleeve comprises two substantially identical oppositely facing sleeve panels defining a slide channel therebetween, said support member cover and upper portion of said support member being slideably received within said slide sleeve.

* * * * *